US008312566B2

(12) United States Patent
Weir et al.

(10) Patent No.: US 8,312,566 B2
(45) Date of Patent: Nov. 20, 2012

(54) TRAINING GARMENT

(75) Inventors: Ross John Weir, Loughborough (GB); Michael Peter Caine, Cropston (GB)

(73) Assignee: Progressive Sports Technologies (GB)

( * ) Notice: Subject to any disclaimer, the term of this patent is extended or adjusted under 35 U.S.C. 154(b) by 162 days.

(21) Appl. No.: 12/680,929

(22) PCT Filed: Sep. 26, 2008

(86) PCT No.: PCT/GB2008/050872

§ 371 (c)(1), (2), (4) Date: Jul. 13, 2010

(87) PCT Pub. No.: WO2009/044187

PCT Pub. Date: Apr. 9, 2009

(65) Prior Publication Data

US 2010/0269240 A1 Oct. 28, 2010

(30) Foreign Application Priority Data

Oct. 2, 2007 (GB) ..... 0719200.8

(51) Int. Cl.
*A41D 31/02* (2006.01)
*A41B 1/08* (2006.01)
*A41D 1/00* (2006.01)

(52) U.S. Cl. ..... 2/69; 2/67; 2/94; 2/115

(58) Field of Classification Search ..... None
See application file for complete search history.

(56) References Cited

U.S. PATENT DOCUMENTS 2,097,376 A * 10/1937 Marshman ..... 482/124
2,613,932 A * 10/1952 Manners ..... 482/124
2,664,566 A * 1/1954 Mianulli ..... 2/457
3,411,500 A * 11/1968 Gatts ..... 600/20
3,561,436 A * 2/1971 Gaylord, Jr. ..... 602/19
3,759,510 A * 9/1973 Jackson, Jr. ..... 482/105
4,325,379 A * 4/1982 Ozbey ..... 450/116
4,384,369 A * 5/1983 Prince ..... 2/79
4,412,357 A * 11/1983 Mincher ..... 2/118
4,446,575 A * 5/1984 Davis ..... 2/400
4,466,137 A * 8/1984 Carnaghi ..... 2/237

(Continued)

FOREIGN PATENT DOCUMENTS

DE 2148115 6/1973

(Continued)

OTHER PUBLICATIONS

International Search Report for PCT Application No. PCT/GB2008/050872.

(Continued)

*Primary Examiner* — Bobby Muramoto, Jr.
(74) *Attorney, Agent, or Firm* — Renner Kenner Greive Bobak Taylor < Weber

(57) ABSTRACT

A training garment (10) for developing an athlete's inspiratory muscles, comprises a resistance band (12) and adjustment means (13). The resistance band (12) is configured such that when the training garment (10) is in use during the performance of aerobic exercise, the resistance band (12) embraces the athlete's thorax and imparts a resistive load thereto. The adjustment means (13) enable the athlete to vary the applied resistive load. The training garment (10) resists the expansion of the athlete's thorax during the performance of aerobic exercise, but without restricting the athlete's range of motion.

12 Claims, 2 Drawing Sheets

U.S. PATENT DOCUMENTS

Figure 1:
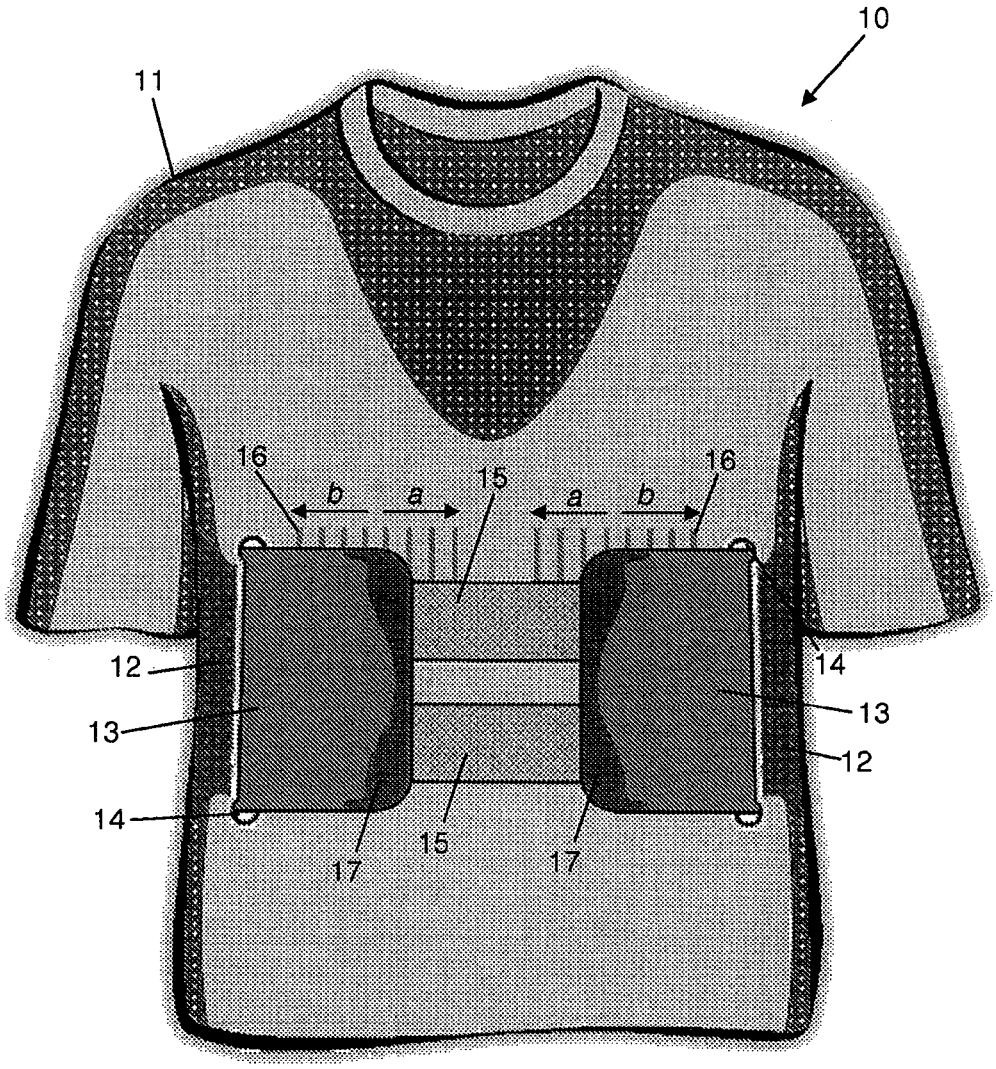

| | | | | | |
|---|---|---|---|---|---|
| 4,741,719 | A | * | 5/1988 | Wirth | 450/30 |
| 4,787,381 | A | | 11/1988 | Hubbard | |
| 4,850,056 | A | * | 7/1989 | Gardner et al. | 2/227 |
| 4,910,802 | A | * | 3/1990 | Malloy | 2/69 |
| 4,913,135 | A | * | 4/1990 | Mattingly | 602/18 |
| 4,953,856 | A | * | 9/1990 | Fox, III | 482/105 |
| 4,961,573 | A | * | 10/1990 | Wehrell | 482/74 |
| 4,993,705 | A | * | 2/1991 | Tolle | 482/124 |
| 5,109,546 | A | * | 5/1992 | Dicker | 2/70 |
| 5,176,600 | A | * | 1/1993 | Wilkinson | 482/124 |
| 5,186,701 | A | * | 2/1993 | Wilkinson | 482/125 |
| 5,201,074 | A | * | 4/1993 | Dicker | 2/70 |
| 5,203,754 | A | * | 4/1993 | Maclean | 482/124 |
| 5,256,119 | A | * | 10/1993 | Tudor | 482/74 |
| 5,263,916 | A | * | 11/1993 | Bobich | 482/124 |
| 5,267,928 | A | * | 12/1993 | Barile et al. | 482/124 |
| 5,306,222 | A | * | 4/1994 | Wilkinson | 482/124 |
| 5,308,305 | A | * | 5/1994 | Romney | 482/124 |
| 5,372,565 | A | * | 12/1994 | Burdenko | 482/124 |
| 5,465,428 | A | * | 11/1995 | Earl | 2/238 |
| 5,570,472 | A | * | 11/1996 | Dicker | 2/69 |
| 5,659,895 | A | * | 8/1997 | Ford, Jr. | 2/2.11 |
| 5,797,890 | A | * | 8/1998 | Goulter et al. | 604/351 |
| 5,829,058 | A | * | 11/1998 | Dicker et al. | 2/69 |
| 6,047,406 | A | * | 4/2000 | Dicker et al. | 2/69 |
| 6,176,816 | B1 | * | 1/2001 | Dicker et al. | 482/124 |
| 7,246,381 | B2 | * | 7/2007 | Green | 2/69 |
| 7,374,523 | B2 | * | 5/2008 | Weir et al. | 482/148 |
| 7,871,388 | B2 | * | 1/2011 | Brown | 602/19 |
| 7,908,670 | B2 | * | 3/2011 | Semba et al. | 2/69 |
| 8,048,014 | B2 | * | 11/2011 | Brown | 602/26 |
| 2004/0133959 | A1 | | 7/2004 | Horii et al. | |
| 2005/0148451 | A1 | * | 7/2005 | Weir et al. | 482/148 |
| 2011/0185508 | A1 | * | 8/2011 | Hsu et al. | 5/706 |

FOREIGN PATENT DOCUMENTS

| | | |
|---|---|---|
| WO | 9508308 | 3/1995 |
| WO | 2004014495 | 2/2004 |

OTHER PUBLICATIONS

U.K. Search Report for corresponding U.K. Application GB0719200.8.

* cited by examiner

TRAINING GARMENT

This invention relates to a training garment for exercising an athlete's inspiratory muscles during the performance of aerobic exercise.

The inspiratory muscles are used during normal respiration to expand the thorax when air is inhaled, thus allowing the lungs to increase in volume. Resisting the expansion of the thorax causes the inspiratory muscles to work harder to achieve the same intake of air into the lungs. By applying resistance to the expansion of an athlete's thorax during the performance of aerobic exercise, his or her inspiratory muscles can therefore be made to work harder. Repetition of such resisted exercise on a regular basis will therefore increase the strength and stamina of the inspiratory muscles, thus enabling the athlete to take in more air during normal, un-resisted exercise—and thus enhance his or her performance.

It should be understood that the present invention is concerned with resisting expansion of the thorax, rather than restricting it. The present invention is intended to allow an athlete to expand his or her thorax to its normal inflated volume, but this expansion will be achieved against an applied resistive load, thereby requiring the athlete's inspiratory muscles to perform additional work.

Previous devices for training the inspiratory muscles have focussed on providing resistance to the athlete's intake of air via a mouthpiece incorporating means for inhibiting the flow of air therethrough, rather than by resisting expansion of the thorax. Such devices have limited applicability to serious sports training, as they do not enable the athlete to develop his or her inspiratory muscles whilst carrying out aerobic exercise specific to their sport, but instead require sessions dedicated to the exercise of the inspiratory muscles alone. Furthermore, such mouthpiece-based training devices tend to be rather unappealing to the user, and also require regular sterilisation.

The applicant's own International Patent Publication No. WO 2004/014495 describes a device which by resisting expansion of the thorax enables an athlete to exercise his or her inspiratory muscles whilst simultaneously performing normal aerobic exercise. The present invention represents a development of the basic concept described in WO 2004/014495 and seeks to provide an improved and simplified training device having greater flexibility, comfort and ease of use.

According to the present invention there is provided a training garment for developing an athlete's inspiratory muscles, said garment comprising a resistance band adapted when in use during the performance of aerobic exercise to embrace the athlete's thorax and impart a resistive load thereto, and adjustment means for varying said resistive load. Preferably, the training garment comprises a single resistance band.

The present invention as presently conceived subsists in four major embodiments: in a first major embodiment, the resistance band essentially stands alone in a cummerbund-type arrangement; in a second major embodiment, the resistance band is provided with means for attachment to a conventional article of clothing; in a third major embodiment the resistance band is adapted for attachment to a carrier garment supplied therewith; and in a fourth major embodiment the resistance band is formed integrally with such a carrier garment. Each of these four major embodiments will be described in more detail below. Unless otherwise indicated, the following discussion of the preferred features of the invention should be construed as referring equally to all four major embodiments.

The training garment of the present invention is intended to resist the expansion of an athlete's thorax during the performance of aerobic exercise, by applying a resistive load to the thorax—but without restricting the athlete's range of motion. The effort required to be exerted by the athlete's inspiratory muscles is increased by the applied resistance, leading to development and training of those muscles. By developing his or her inspiratory muscles utilising the present invention during a training programme, an athlete can reap the benefits when performing competitively without resistance, since the efficiency of his or her inspiratory muscles will be enhanced.

In order to provide the resistive load, the resistance band is preferably formed of elasticated material. The band may be pre-tensioned to some degree, but it is an important feature of the present invention that the tension in the band should be adjustable by the athlete, so that the resistive load imparted by the resistance band to the athlete can be varied. For this purpose, the resistance band preferably terminates at each end thereof in a manually graspable tab, each said tab being provided with one member of a re-sealable closure mechanism, adapted to engage with a complementary member of said re-sealable closure mechanism located on the garment thereby to define at least one fixing strip. By varying the location at which the tabs are secured to the fixing strip(s), the tension in the band—and hence the resistive load imparted to the athlete's thorax—can be varied.

The re-sealable closure mechanism may be any suitable arrangement which enables the tabs to be attached, detached and re-attached at will at a range of locations on the fixing strip(s). Preferably however, the re-sealable closure mechanism is a fabric hook-and-loop system, such as Velcro®.

As will be apparent from the above discussion, the manually graspable tabs, the fixing strip(s) and the re-sealable closure mechanism together constitute the adjustment means as referred to hereinbefore.

In order to facilitate the attachment and detachment of the manually graspable tabs, each tab may be provided with a grip element formed from a suitable high friction material. Alternatively, and preferably, each tab may be provided a with finger-mitt portion adapted to accommodate the athlete's fingertips.

So as to provide a visual indication of the differing levels of resistance associated with attaching the tabs at each of the range of locations along the fixing strip(s), at least one said strip is preferably provided with markings at each of said range of locations.

Maximum training efficiency is achieved by locating the resistance band such that it is adapted to embrace the athlete's lower ribcage, when the garment is in use. The lower portion of the ribcage is the region in which the most dynamic movement of breathing occurs. Preferably, the resistance band is adapted to extend around the user's back, with the manually graspable tabs disposed at the front of the user's thorax. Most preferably, the or each fixing strip is disposed at the front of the user's thorax, and arranged so as to be substantially coplanar with the resistance band and the manually graspable tabs.

The first major embodiment of training garment according to the present invention consists essentially of a resistance band and adjustment means, as hereinbefore described. The first major embodiment thus provides a cummerbund-type arrangement adapted to embrace the athlete's thorax.

The second major embodiment of training garment according to the present invention further comprises attachment means to enable the training garment in use to be attached to a conventional article of clothing on an athlete's thorax. Preferably, the attachment means comprise one or more clips to enable said attachment.

In the third and fourth major embodiments of training garment according to the present invention, the training garment further comprises a carrier garment associated with the resistance band and adjustment means, as hereinbefore described.

The purpose of the carrier garment is effectively to hide the resistance band from view, so as to mask any unsightly bulges in the athlete's profile which may be caused by wearing the resistance band. It is therefore preferable that the resistance band is located internally of the carrier garment, and that the carrier garment is loose fitting, so that in use the resistance band is visually indiscernible.

However, in order to ensure that the training garment of the present invention retains its capacity to enable the tension in the resistance band to be varied by the athlete during use, it is highly preferable that the adjustment means should remain external of the carrier garment. This is preferably achieved by providing the carrier garment with a pair of spaced opposed slits at the front thereof, adapted to allow the manually graspable tabs of the resistance band to emerge therethrough. The or each fixing strip is then preferably located on the front of the carrier garment, between said spaced slits.

The development of the inspiratory muscles attributable to the present invention will be of benefit to athletes performing in a wide range of sports. However, it is envisaged that the present invention will be particularly of benefit to swimmers and performer of other aquatic sports. Therefore, in certain variants of the third and fourth major embodiment of the present invention, the training garment is preferably formed from substantially waterproof fabric for aquatic use.

In the third major embodiment of training garment according to the present invention, at least the resistance band, and preferably also the adjustment means, is/are detachable from the carrier garment. The detachment of the resistance band, and optionally also the adjustment means, may be effected via a seam provided centrally on the back of the carrier garment. Alternatively, the detachment of the resistance band, and optionally also the adjustment means, may be effected via the spaced opposed slits at the front of the garment. The third major embodiment may thus be supplied in the form of a kit of parts comprising the carrier garment and the resistance band.

In the fourth major embodiment of training garment according to the present invention, the resistance band and adjustment means are formed integrally with the carrier garment, as a single unit.

Figure 2:
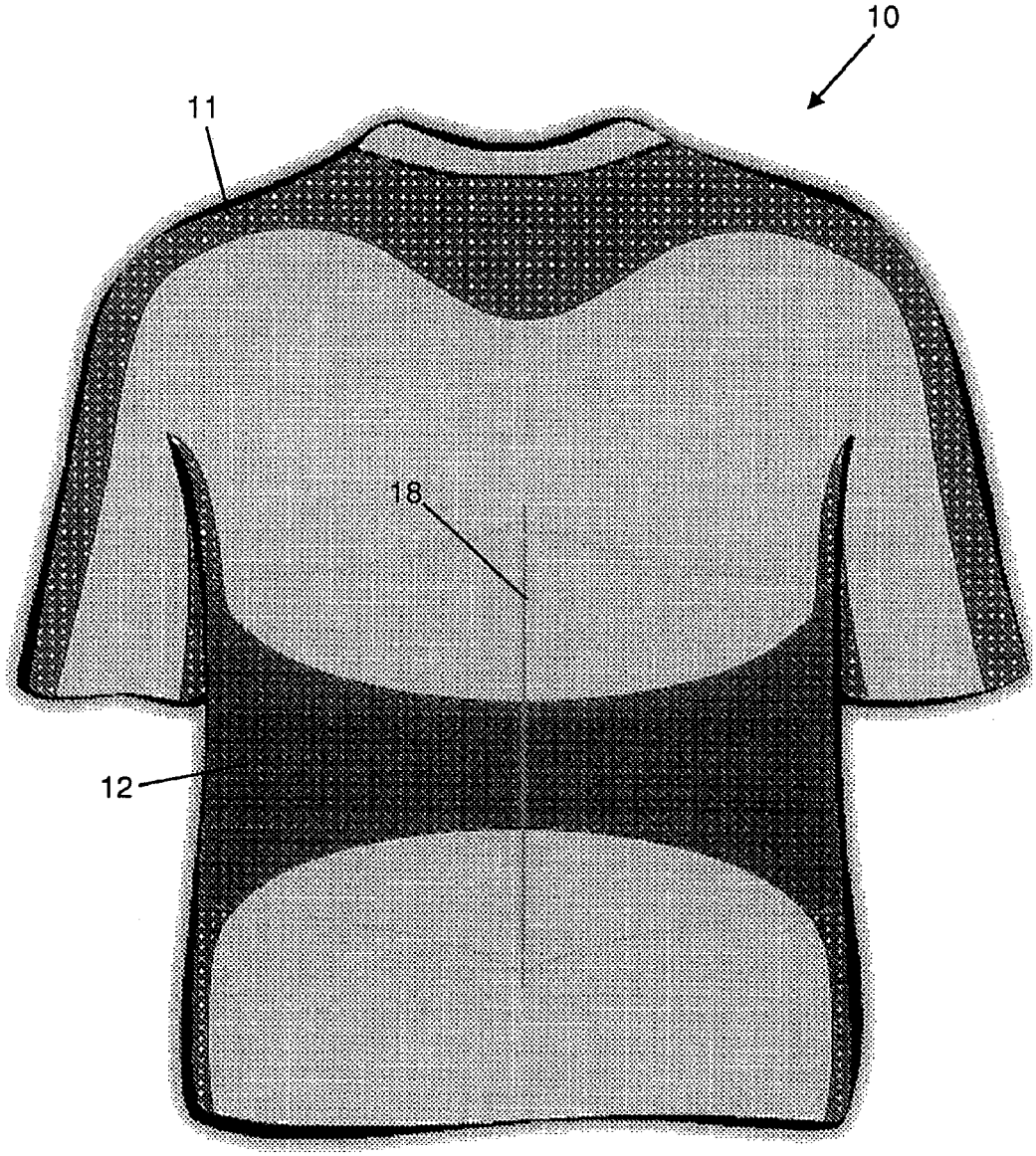

In order that the present invention may be better understood, a preferred embodiment thereof (corresponding to the third or fourth major embodiment described above) will now be described in detail, though only by way of example, with reference to the accompanying drawings, in which:

FIG. 1 shows a front view of a training garment according to a preferred embodiment of the present invention; and FIG. 2 shows a rear view of the training garment of FIG. 1.

Referring simultaneously to FIGS. 1 and 2, there is shown a training garment, generally indicated 10, according to a preferred embodiment of the present invention, for use by an athlete (not shown) during training so as to exercise and develop his or her inspiratory muscles. The training garment 10 comprises a carrier garment 11, in which is incorporated a resistance band 12.

The resistance band 12 extends around the back of the carrier garment 11, as is shown in FIG. 2—but it should be understood that the band 12 is incorporated internally of the carrier garment 11, such that said band 12 is in contact with the athlete's skin, or undergarment. FIG. 2 thus illustrates shading on the carrier garment 11 corresponding to the position of the resistance band 12 therebeneath.

The resistance band 12 terminates at each end thereof in a manually graspable tab 13. The tabs 13 emerge from the carrier garment 11 through spaced opposed slits 14 provided at the front thereof, so that the tabs 13 are thus available for adjusting the tension in the resistance band 12 from the exterior of the carrier garment 11. By having the resistance band 12 incorporated within the interior of the carrier garment 11, but transferring to the exterior of the carrier garment 11 for adjustment by use of the tabs 13, the training garment 10 of the present invention minimises or avoids aesthetically unappealing effects such as unsightly bulges and the like, since the carrier garment 11 hangs loosely over the resistance band 12, as can be seen from FIG. 1.

The underside of each of the tabs 13 (not visible) is provided with one component of a hook and loop closure system such as Velcro®, with the other component of said system being carried on fixing strips 15 extending between the slits 14 on the front of the carrier garment 11. The fixing strips 15 are further provided with markings 16 at a range of locations corresponding to different applied resistive loads. As can be seen in FIG. 1, one set of markings 16 is associated with each manually graspable tab 13. The resistive load is increased as the location of each tab 13 on the fixing strips 15 is moved inwardly, as indicated by arrows a, and will be decreased as the tabs 13 are moved outwardly, as indicated by arrows b.

In order to adjust the resistive load applied by the resistance band 12, the tabs 13 are simply detached from the fixing strips 15, and moved to a new location on the fixing strips 15 either corresponding to an increased a or decreased b resistive load, using the markings 16 as a guide, before being re-attached to the fixing strips 15.

To facilitate the detachment, adjustment and re-attachment of the tabs 13 on the fixing strips 15, the tabs 13 are each provided with finger-mitt portions 17. In use, the athlete may simply insert his or her fingertips into the finger-mitt portions 17, which can then be used to facilitate peeling the tabs 13 off the fixing strips 15 and reapplying them thereto.

As can best be seen from FIG. 2, the resistance band 12 is adapted to embrace a region of the athlete's thorax corresponding to the lower portion of the ribcage, since this is the region in which the most dynamic movement of breathing occurs.

As can also be seen from FIG. 2, a central seam 18 may be provided, said seam 18 running up the back of the carrier garment 11. The resistance band 12 can be inserted into the carrier garment 11 through this central seam 18. This is of particular importance in the third major embodiment of the present invention, in which the resistance band 12 is removably attached to the carrier garment 11, and may be removed and re-inserted through the seam 18 as required. Alternatively, the resistance band 12 may be inserted into and removed from the carrier garment 11 through the spaced opposed slits 14 provided at the front thereof. This is of particular importance in embodiments of the present invention in which the central seam 18 is absent.

The invention claimed is:

1. A training garment for developing an athlete's inspiratory muscles during a performance of aerobic exercise, said training garment comprising:

a resistance band terminating at first and second ends, said resistance band being arranged to extend around an athlete's back and to embrace the athlete's thorax and to impart a resistive load thereto when the training garment is in use;

a carrier garment associated with the resistance band and having a front and a back; and an adjuster for varying said resistive load, said adjuster comprising:

a manually graspable tab provided on each of said first and second ends of the resistance band, said manually graspable tabs being disposed in front of the athlete's thorax when the training garment is in use; and a re-sealable closure mechanism, comprising a first member located on the front of the carrier garment thereby to define at least one fixing strip disposed in front of said athlete's thorax when the training garment is in use, and a second member provided on each said manually graspable tab, each said second member being complementary to said first member and being adapted to engage therewith.

2. The training garment as claimed in claim 1, wherein the re-sealable closure mechanism enables the manually graspable tabs to be attached, detached and re-attached at will at a range of locations on the at least one fixing strip.

3. The training garment as claimed in claim 2, wherein the at least one fixing strip is provided with markings at a range of locations thereon to indicate the level of resistive load associated with attaching the tabs at each said location.

4. The training garment as claimed in claim 1, wherein the at least one fixing strip is co-planar with the resistance band and the manually graspable tabs.

5. The training garment as claimed in claim 1, wherein the resistance band is adapted to embrace an athlete's lower ribcage, when the training garment is in use.

6. The training garment as claimed in claim 1, wherein the resistance band is located internally of the carrier garment.

7. The training garment as claimed in claim 6, wherein the front of the carrier garment comprises a pair of spaced opposed slits, adapted to allow the manually graspable tabs of the resistance band to emerge therethrough.

8. The training garment as claimed in claim 7, wherein the at least one fixing strip is located on the front of the carrier garment, between said spaced slits.

9. The training garment as claimed in claim 1, wherein the resistance band and the adjuster are formed integrally with the carrier garment.

10. The training garment as claimed in claim 1, wherein the resistance band is detachably removable from the carrier garment.

11. The training garment as claimed in claim 10, wherein the back of the carrier garment comprises a seam located centrally thereon, and wherein the resistance band is detachably removable from the carrier garment via said seam.

12. The training garment as claimed in claim 10, wherein the front of the carrier garment comprises a pair of spaced opposed slits adapted to allow the manually graspable tabs of the resistance band to emerge therethrough, and wherein the resistance band is detachably removable from the carrier garment via the spaced opposed slits.

* * * * *